United States Patent [19]

Repa

[11] 4,291,476

[45] Sep. 29, 1981

[54] SIGHT RAIL FOR SHOULDER FIREARMS

[75] Inventor: Otto Repa, Oberndorf, Fed. Rep. of Germany

[73] Assignee: Mauser-Werke Oberndorf GmbH, Fed. Rep. of Germany

[21] Appl. No.: 25,272

[22] Filed: Mar. 29, 1979

[30] Foreign Application Priority Data

Apr. 8, 1978 [DE] Fed. Rep. of Germany ... 7810514[U]

[51] Int. Cl.[3] ..... F41G 1/38

[52] U.S. Cl. ..... 42/1 ST; 42/1 SR

[58] Field of Search ..... 42/1 ST, 1 SR; 33/245, 33/250

[56] References Cited

U.S. PATENT DOCUMENTS 2,475,383 7/1949 Foster ..... 42/1 ST 2,580,246 12/1951 Schall ..... 42/1 ST 3,255,546 6/1966 Dahl et al. ..... 42/1 SR 3,491,975 1/1970 Weaver ..... 42/1 ST

*Primary Examiner*—Charles T. Jordan

*Attorney, Agent, or Firm*—McGlew and Tuttle

[57] ABSTRACT

A sight rail device for securing a sighting telescope to a shoulder firearm which includes a receiver having a barrel secured thereto and with a plurality of upright internally threaded hollow tubular mounting bolts disposed along the barrel and also partly along the receiver, comprises, a sight rail having an underside which conforms to the barrel and is disposed to overlie a portion of each and has a plurality of receiving bores defined in the underside which open toward the barrel and the receiver into which the mounting bolts extend. The sight rail also includes a dovetail-shaped sight-receiving recess for easily mounting the sight and a dovetail-shaped recess for easily mounting a baseplate for securing the sighting telescope.

5 Claims, 1 Drawing Figure

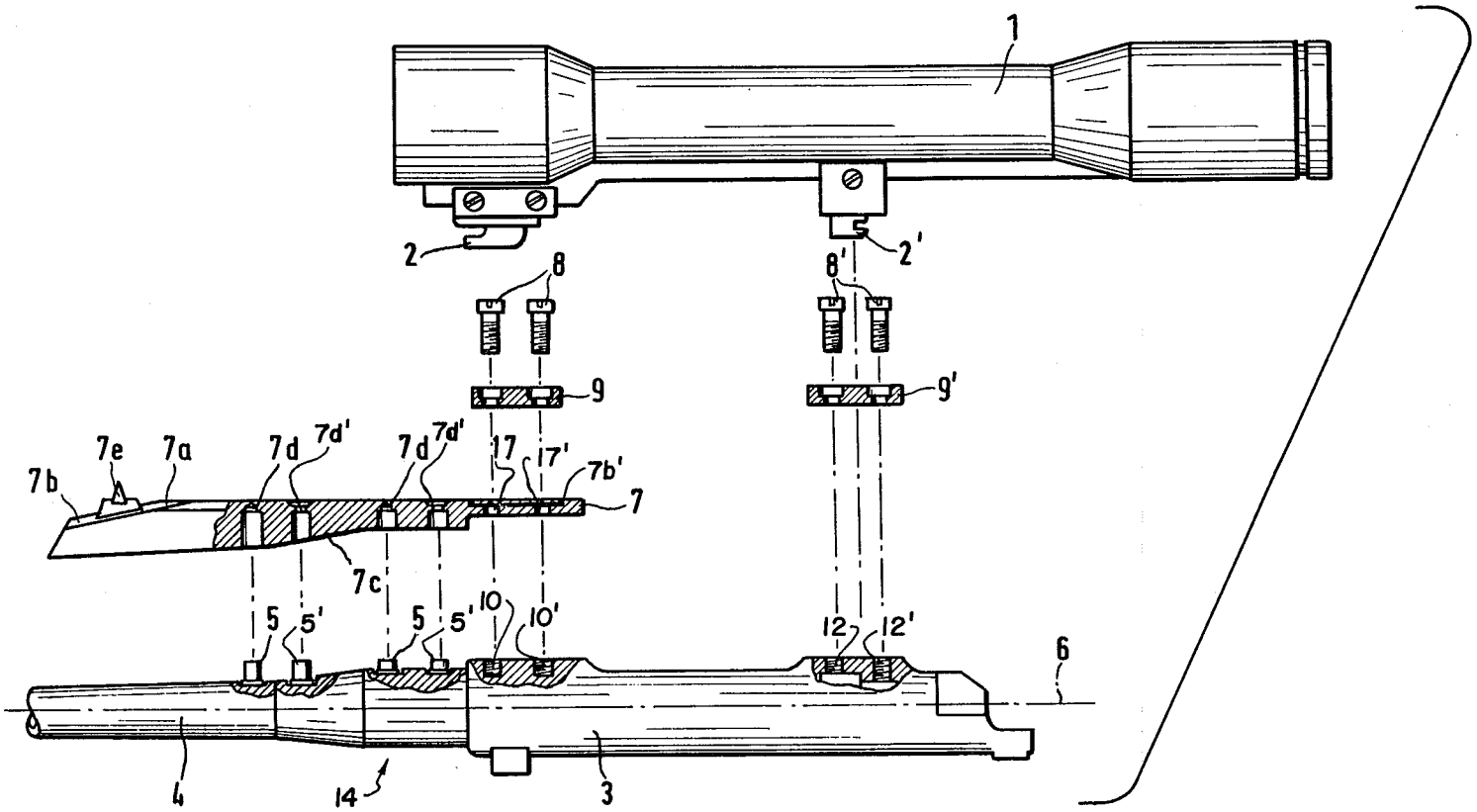
1
2
2'
8
8'
9
9'
7
7a
7b
7b'
7c
7d
7d'
7e
17
17'
5
5'
10
10'
12
12'
3
4
6
14

SIGHT RAIL FOR SHOULDER FIREARMS

FIELD AND BACKGROUND OF THE INVENTION

The present invention relates to firearms in general and, in particular, to a new and useful device for detachably securing a sighting telescope on a shoulder firearm, while using a sight rail extending at least partly on the barrel and the associated receiver.

DESCRIPTION OF THE PRIOR ART

While aiming at a target over a rear sight and bead, the eye of the marksman must adapt simultaneously to three points, that is, to the rear sight next to the eye, then to the bead, and finally to the target. These points are unequally spaced from the eye. Only a marksman with normal signal sees all three points equally sharp, while individuals with defective sight see one or the other of the points only indistinctly. This practically prevents an exact aiming and coincidence.

These mentioned above and similar inconveniences may be avoided to a large extent by using sighting telescopes. Their mounting on the weapon, however, requires the greatest attention of the armorer. With a mounting which is not expert, the best sighting telescope is practically useless.

In order to connect a sighting telescope to an arm, so-called attachments are employed. Such attachments may comprise, for example, fixtures which are secured to the sighting telescope and have legs, while baseplates or prism rails are provided on the rifle. The legs are connected to these corresponding baseplates, that is, the sighting telescope is locked to the weapon in various ways, for example, by means of hooking, sliding or hinged engagement.

In the prior art designs, the body of the sighting telescope which is made of steel, as a rule, is brazed to the attachment. However, this requires the taking apart and removal of the optical system in advance, which may cause deficiencies in the disassembly and adjusting of the optical system.

In certain designs, for example, if the legs of the attachment are made of a light metal which cannot be brazed, it is known to provide a sort of indirect connection with the barrel in the form of a mounting rail secured to the underside of the body of the sighting telescope. The correspondingly shaped legs are screwed to the rail and inserted into the corresponding baseplates.

Even though such designs have proven to be satisfactory under certain conditions by eliminating stresses in the optical system and/or the body of the telescope, and have made it possible to avoid the disassembly of the sighting telescope, they do not comply to a sufficient extent with the necessity of a universal utilization and with the requirements of hunting practice.

SUMMARY OF THE INVENTION

Starting with a sight rail which serves the purpose of connecting a plurality of barrels and which, as a rule, extends over the entire length of the barrels, the present invention is directed to an improvement of the hitherto known methods of securing a sighting telescope on shoulder firearms, which simplifies the securing thereof and makes it universally usable.

In accordance with the invention, the firearm includes a barrel which is secured to a receiver in alignment therewith. The barrel includes a plurality of hollow upright bolt members which are internally threaded, for example, for receiving securing screws, as well as hollow receiving recesses which are defined along the length of the receiver. A sight rail in the form of a member made in a material, such as metal, overlies the barrel and a portion of the receiver, and it is provided with receiving bores into which the bolts of the barrel engage as well as additional bores which align with the bores of the receiver so that securing screws may be secured therethrough.

In addition, the sight rail includes a dovetail recess on its top to permit easy engagement of the baseplate for the sighting telescope which is secured by the securing screws which engage through the baseplate and into the receiving recesses of the sight rail and the receiver. Another dovetail recess is defined at the end of the sight rail which carries an adjustable sight member. The sighting telescope itself advantageously includes mounting brackets with hook-shape members which extend in respective opposite directions which engage into respective baseplates which are fitted over the receiver and over the receiving groove of the sight rail.

The present invention offers a number of advantages. Aside from the fact that the securing device for a sighting telescope is relatively simple in design, it has the eminent advantage of being universal, since sighting telescopes of various geometrical configuration may be employed. That is, the sight rail is equally well adapted for any of the known kinds of mounting, such as mounting by hooking, hinging or clamping. A further advantage is, among others, that it is no longer necessary to burnish the arm again after mounting the sighting telescope, since all prefabricated securing points are situated within the range of the sight rail and can be subjected to the burnishing operation independently of the arm.

Accordingly, an object of the present invention is to provide a sight rail for shoulder firearms for securing a sighting telescope to a shoulder firearm of a type which includes a receiver having a barrel secured thereto which has a plurality of upright internally threaded hollow tubular mounting bolts which are disposed at longitudinally spaced locations along the length of the barrel and the receiver of the firearm or at least along the barrel itself and which comprises a sight rail having an underside conformable to the receiver and barrel and disposed to overlie at least a portion of each, and having a top surface with at least one sighting telescope and sight mount dovetailed receiving recess, and a plurality of bores which open downwardly toward the barrel and the receiver and into which the mounting bolts extend.

A further object of the present invention is to provide a device for securing a sighting telescope to a shoulder firearm which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is an exploded, partial side elevational and partial sectional view of a shoulder firearm having a sight rail constructed in accordance with the invention.

DESCRIPTION OF THE PREFERRED EMBODIMENT

Referring to the drawing in particular, the invention embodied therein, comprises, a firearm which includes a barrel 4 which is secured to one end of a receiver 3 for alignment therewith.

In accordance with the invention, the barrel 4 and/or the receiver 3, or both, are provided with a plurality of sets of upright bolts 5 and 5' which, for example, may be hollow and internally threaded. In addition, the receiver or the barrel, or both, may also be provided with similar sets of threaded receiving bores 10 and 10' and 12 and 12'.

In accordance with the invention, a sighting telescope 1, as well as a sight *7e*, is mounted on the firearm, generally designated 14, which includes the barrel 4 and the receiver 3 by means of a sight rail 7. For this purpose, the sight rail 7 is advantageously provided with dovetail recess means *7b* into which the sight *7e* is engaged at a bevelled front end *7a* of the sight rail. Similar recess means *7b'* are also provided for the engagement of a baseplate 9 which provides a mount for the sighting telescope 1 along with a second baseplate 9'. Baseplates 9 and 9' are secured by sets of screws or bolts 8 and 8' which engage through respective openings of the baseplates 9 and 9' and through the receiving bores 10, 10' and 12, 12', respectively. The telescope sight 1 advantageously includes a mounting bracket having oppositely directed hook elements 2 and 2' which engage into the respective baseplates 9 and 9'. The hooks 2 and 2' are mounted so that they are at spaced longitudinal locations.

The upright bolts 5 and 5' are arranged in pairs which are spaced longitudinally and each of them is provided with tapholes and arranged along the axis 6 of the barrel bore. The bolts 5 and 5' are advantageously secured to the barrel by suitable electrowelding processes.

The sight rail 7 which has an underside *7c* which conforms to the configuration of the barrel 4 and receiver 3, including the front end of the receiver, which includes the barrel part *7a*, carries a dovetail recess *7b*. The sight *7e* is of a type which may be slid along the dovetail recess and anchored at a selected location in order to adjust the height of the sight.

A plurality of covered bores or recesses *7d* and *7d'* are arranged in pairs corresponding to the number and arrangement of the upright bolts 5 and 5' which are fixed to the barrel. In addition, the sight rail is provided with receiving bores 17 and 17' which provide passages for screws 8 which pass through the baseplate 9 and into receiving bores 10 and 10', respectively. The screws 8 thus function to hold both the sight 1 and the sight rail to the firearm which includes receiver 3 and barrel 4. Similarly, bores 12 and 12' provide threaded bore receivers for the screws 8' which extend through the baseplate 9' and provide means for mounting the rear end of the telescope sight 1.

The references which were taken into account in respect to this application are as follows:

Lampel, W. and Mahrhold, R. "Waffenlexikon für Jäger und Schützen" (Encylopedia of Firearms for Hunters and Marksmen), Sixth Edition, 1966, page 258 and page 569 ff. Publisher: F. C. Mayer Verlag, Münich-Solln.

While a specific embodiment of the invention has been shown and described in detail to illustrate the application of the principles of the invention, it will be understood that the invention may be embodied otherwise without departing from such principles.

I claim:

1. A device for securing a sighting telescope to a shoulder firearm, which firearm includes a receiver having a barrel secured thereto, and with a plurality of upright internally threaded, hollow, tubular mounting bolts disposed along the length of the receiver and barrel at spaced locations, comprising, a sight rail having an underside conformable to the receiver and the barrel and disposed to overlie at least a portion of each and having a top surface with at least one sighting telescope and sight mount dovetailed recess defined thereon, and a plurality of bores opening downwardly in said sight rail into which the mounting bolts extend.

2. A device, as claimed in claim 1, wherein said at least one sighting telescope and sight mount dovetailed receiving recess comprises a first recess adjacent the front end of said sight rail and a second recess spaced rearwardly of said first recess, a sight disposed in said first recess and a baseplate for mounting the sighting telescope disposed in the other of said recesses.

3. A device, as claimed in claim 1, wherein said receiver includes two spaced bores defining a threaded receiving recess, said sight rail having a through bore therethrough overlying said threaded bores of said receiver and including a baseplate for mounting a telescope sight having bores therethrough and securing screws extending through the bores of said baseplate and the bores of said sight rail into the receiving threaded bores of said receiver.

4. A device, as claimed in claim 1, wherein said barrel carries said internally threaded hollow tubular mounting bolts in longitudinally spaced pairs, said mounting bolts being receivable into the bores of said sight rail, at least two sets of spaced apart threaded bores defined in said receiver, one set of which underlies said sight rail, said sight rail having throughbores defined therethrough overlying said one set of said threaded bores of said receiver, and a telescope sight mounting base positioned on the top of said sight rail having bores located over the throughbores of said sight rail and securing screws extending through the bores of said baseplate, said sight rail and into the receiving bores of said receiver.

5. A device, as claimed in claim 4, including a second baseplate overlying said receiver at a location spaced rearwardly from said baseplate and having spaced bores overlying spaced threaded receiving bores of said receiver and securing bolts extending through the bores into the threaded receiving bores of said receiver for said second baseplate.

* * * * *